United States Patent [19]

Hayakawa et al.

[11] Patent Number: 4,990,423

[45] Date of Patent: Feb. 5, 1991

[54] PHOTOSENSITIVE MEMBER FOR ELECTROPHOTOGRAPHY

[75] Inventors: Takashi Hayakawa, Nara; Shiro Narikawa, Kashihara; Kunio Ohashi, Nara, all of Japan

[73] Assignee: Sharp Kabushiki Kaisha, Osaka, Japan

[21] Appl. No.: 368,807

[22] Filed: Jun. 20, 1989

[30] Foreign Application Priority Data

Jun. 30, 1988 [JP] Japan ..... 63-164480

[51] Int. Cl.[5] ..... G03G 5/082

[52] U.S. Cl. ..... 430/85; 430/95; 430/130; 430/134

[58] Field of Search ..... 430/84, 85, 130, 134, 430/95

[56] References Cited

U.S. PATENT DOCUMENTS

| | | | |
|---|---|---|---|
| 4,265,991 | 5/1981 | Hirai et al. | 430/64 |
| 4,405,702 | 9/1983 | Shirai et al. | 430/84 X |
| 4,471,042 | 9/1984 | Komatsu et al. | 430/64 |
| 4,532,199 | 7/1985 | Ueno et al. | 430/128 |
| 4,760,008 | 7/1988 | Yamazaki et al. | 430/127 |

FOREIGN PATENT DOCUMENTS 60-35059 8/1985 Japan .

OTHER PUBLICATIONS

Brodsky, M. H. et al., entitled, "Quantitative Analysis of Hydrogen in Glow Discharge Amorphous Silicon", Applied Physics Letters, vol. 30, No. 11, Jun. 1977, pp. 561–563.

Copy of pp. 198–211 of "Recent Amorphous Si Handbood", and an English Translation of pp. 208 and 209, 3/31/83.

*Primary Examiner*—J. David Welsh

*Attorney, Agent, or Firm*—Sandler, Greenblum & Bernstein

[57] ABSTRACT

A photosensitive member for electrophotography which comprises a conductive substrate and a photoconductive layer, the photoconductive layer being an amorphous silicon germanium containing hydrogen and/or a halogen at a specific amount, deposited by electron cyclotron resonance method, which is useful for image formation apparatus such as a laser printer.

22 Claims, 5 Drawing Sheets

PHOTOSENSITIVE MEMBER FOR ELECTROPHOTOGRAPHY

BACKGROUND OF THE INVENTION

1. Field of the Invention

The invention relates to a photosensitive member for electophotography used for image formation apparatus in an electrophotographic technology, and more particularly to a photosensitive member for a laser printer comprising a semiconductor laser as a light source.

2. Description of the Prior Art

Recent image formation apparatus in an electrophotographic technology employs a semiconductor laser as a light source, wherein a shortest wave length is 780–830 nm for a stable high output in the practically used semiconductor laser. In the meantime, a photosensitive member used in a conventional image formation apparatus or a photosensitive member employing an amorphous silicon not including Ge as photoconductive layer are lower in the range of longer wave length, so that it is expected to practically use such a photosensitive employing an amorphous silicon having Ge as photoconductive layer (called hereinafter a-SiGe) with a higher sensitivity in the longer wave length range.

a-SiGe has such advantages as (1) longer life, (2) harmless to men and (3) highly sensitive to a longer wavelength.

Conventionally, a photoconductive layer of a-SiGe is made by the plasma CVD method, the sputtering method or the like. A total content of hydrogen and/or halogen (to be applied corresponding to any material gas) in the photoconductive layer that is utilized as photosensitive member for electrophotography and formed through the above-mentioned methods is limited as having 10–40 atomic % (USP No. 4,265,991).

Also, when the above-mentioned methods are used to make a total content of hydrogen and/or halogen to 40 atomic % or more by lowering a temperature of a substrate used, the resulting photoconductive layer is considerably lower in photosensitivity, and hence can not be put into practical use.

It is expected that the photosensitive member with the conventional a-SiGe photoconductive layer (called hereinafter a-SiGe photosensitive member) could get a higher sensitivity in the longer wavelength range by making smaller an optical band gap in comparison with that of using a-Si not containing Ge, but it has in practice an insufficient photosensitivity, and is smaller in dark resistivity to thereby be notably poor in charge acceptance and dark decay characteristic, so that it is still not enough to be used as a photosensitive member using Carlson process. This may be due to the fact that a total content of hydrogen and/or halogen in the photoconductive layer is smaller, so that hydrogen and/or halogen are not sufficiently coupled with Ge atom and hence the dangling bonds of Ge atoms are increased. Also, when the temperature of a substrate is lowered to increase hydrogen and/or halogen content the photosensitivity is not sufficient due to having formed a chain bond of $(SiH_2)n$.

Under such problems, the present invention intends to provide an electrophotographic photosensitive member which has an improved electric property of photoconductive layer comprising a-SiGe.

In the meantime, it has been proposed to deposit an amorphous silicon film by electron cyclotron resonance method (called hereinafter as ECR method)(see USP No. 4,532,199).

SUMMARY OF THE INVENTION

The present invention provides a photosensitive member for electrophotography which comprises a conductive substrate and a photoconductive layer, the photoconductive layer being an amorphous silicon germanium containing hydrogen and/or a halogen at 40–65 atomic %, deposited by electron cyclotron resonance method.

Also, the present invention provides a manufacturing method for the above-mentioned photosensitive member for electrophotography.

The electrophotography photosensitive member according to the invention, is superior in electric properties such as charge acceptance and dark decay characteristic, photosensitivity and the like. The manufacturing method can provide the photosensitive member for electrophotography with good yield and cheapness.

PREFERRED EMBODIMENT OF THE INVENTION

Figure 4:
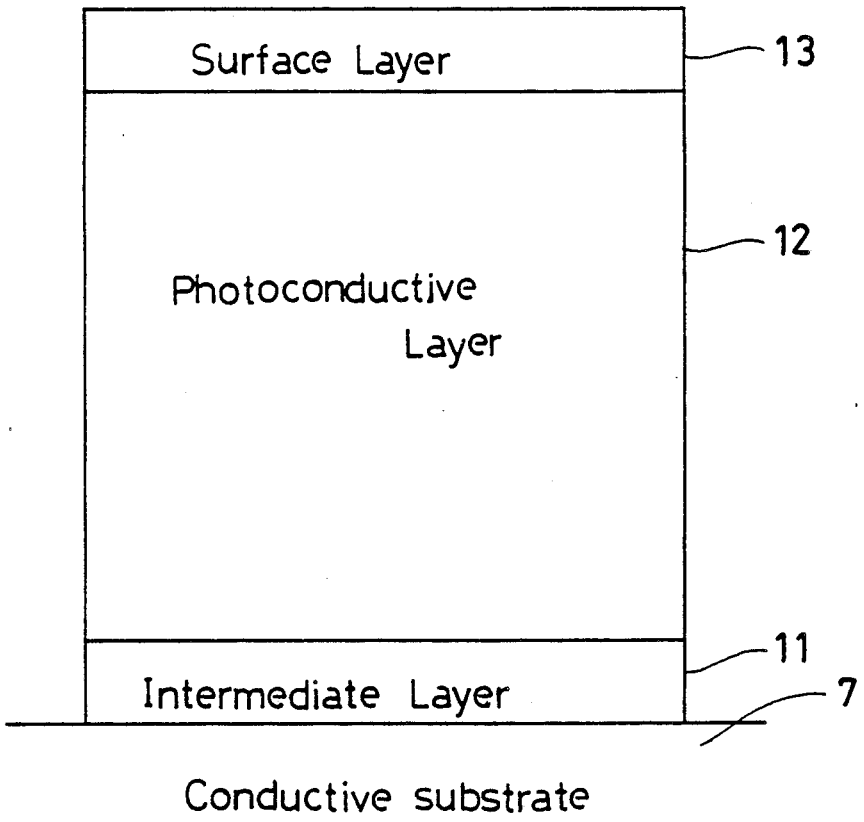
FIG. 4 is an explanatory view showing one construction of the photosensitive member for electrophotography of the present invention.

The electrophotographic photosensitive element of the invention is basically composed by a conductive substrate and a photoconductive layer, but may have an intermediate layer therebetween and a surface-covering layer on a free surface of the photoconductive layer (see FIG. 4).

The conductive substrate may employ conventional materials available in the art, for example, metals such as Al, Cr, Mo, Au, Ir, Nb, Ta, Pt, Pd and the like, or a plate made from alloys provided from those metals. Also available are a film or a sheet made of synthetic resins such as polyester, polyethylene, cellulose acetate, polypropylene and the like, or a sheet made of glass, ceramic and the like, surfaces of those materials being subjected to conductivity process. The substrate may be formed in any shape suitable for the purpose and is not limited to a particular shape.

Tests made by the present inventors showed that when a total content of hydrogen and/or halogen (for example Cl or F) contained in a-SiGe photoconductive layer is more than about 40 atomic %, dark resistivity becomes more than $10^{11}\Omega$cm to thereby be able to have an improved charge acceptance and dark decay characteristic. And, when the total content of hydrogen and/or halogen exceeds about 65 atomic %, optical band gap increases to eliminate a reduction effect for optical band gap achieved by addition of Ge, thereby lowering a sensitivity in longer wavelength range, and resulting in an insufficient feature for photosensitive for laser semiconductor.

The a-SiGe photoconductive layer according to the present invention, contains the above-mentioned larger amount of hydrogen and/or halogen, as could not achieve sufficient photosensitivity in the members prepared by the conventional P-CVD or sputtering method. Thus, it is believed that a structure or bonding which is physically and chemically different from those formed by the conventional method, is formed in the photoconductive layer.

Furthermore hydrogen content of a-Si film deposited by ECR method, which was mentioned in USP No. 4,532,199, is never more than 40%, because the deposition condition mentioned in USP No. 4,532,199 was quite different from one the present inventors mention here.

Figure 1:
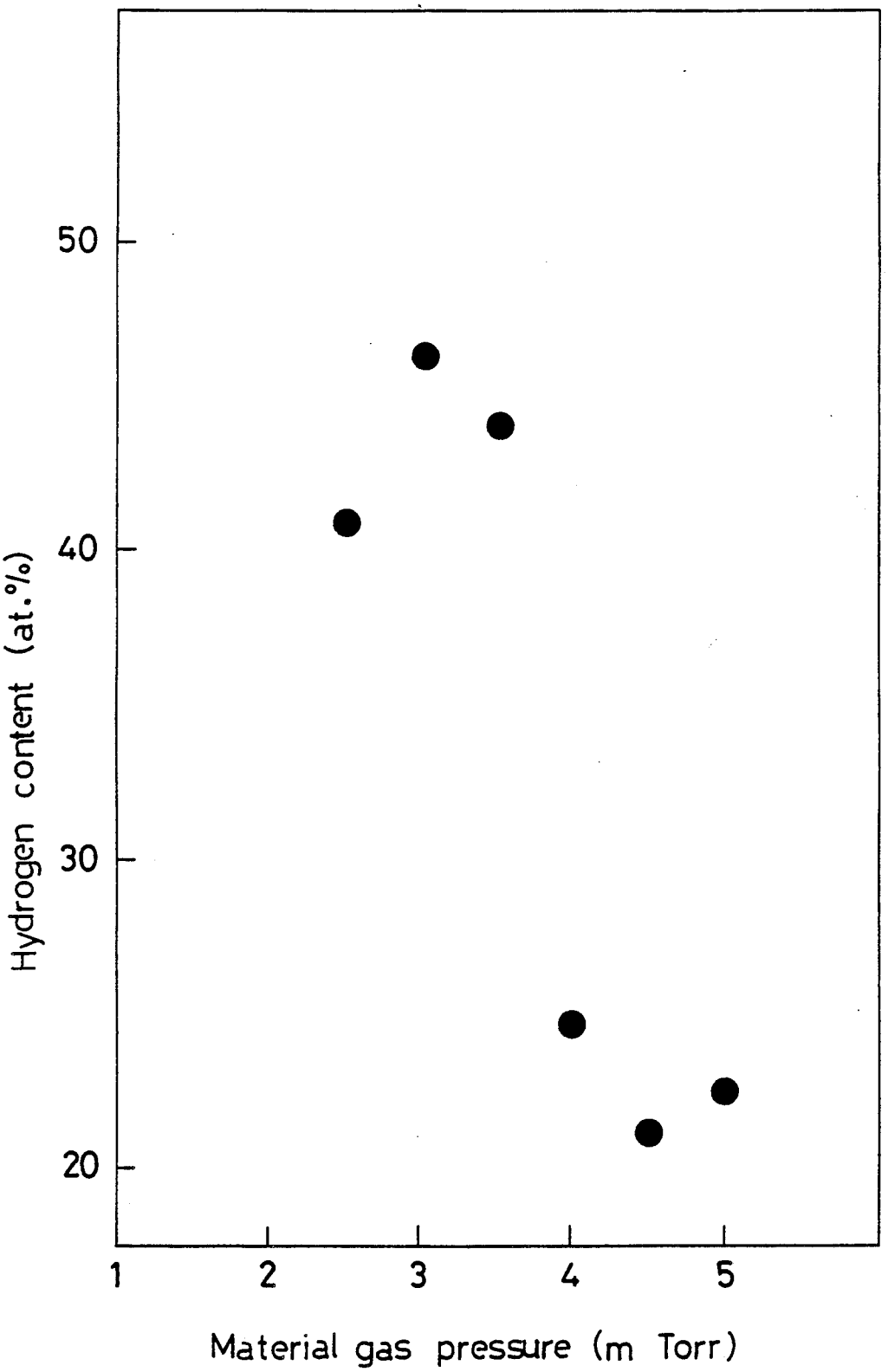
FIG. 1 is an explanatory view showing the relationship between hydrogen content in the a-SiGe photoconductive layer deposited by ECR method and the material gas pressure upon film deposition.

As shown in FIG. 1, holding the following condition is very important to obtain the a-Si film whose hydrogen content is more than 40% and properties are satisfactory for the photosensitive member for electrophotography;

Microwave output : 2.5 kw
Gas flow rate : 120 sccm
Gas pressure : 2.5–3.5 m Torr
Heating to the substrate : none When an addition amount of Ge in the a-SiGe photoconductive layer is less than 5.3 atomic % with respect to that of Si, there appears no effect of the addition of Ge to thereby have larger optical band gap so as to provide a poor sensitivity in a longer wavelength range. Furthermore, when the Ge addition amount is more than 150 atomic % with respect to that of Si, dark resistivity is smaller to deteriorate a charge acceptance and dark decay characteristic.

Figure 5:
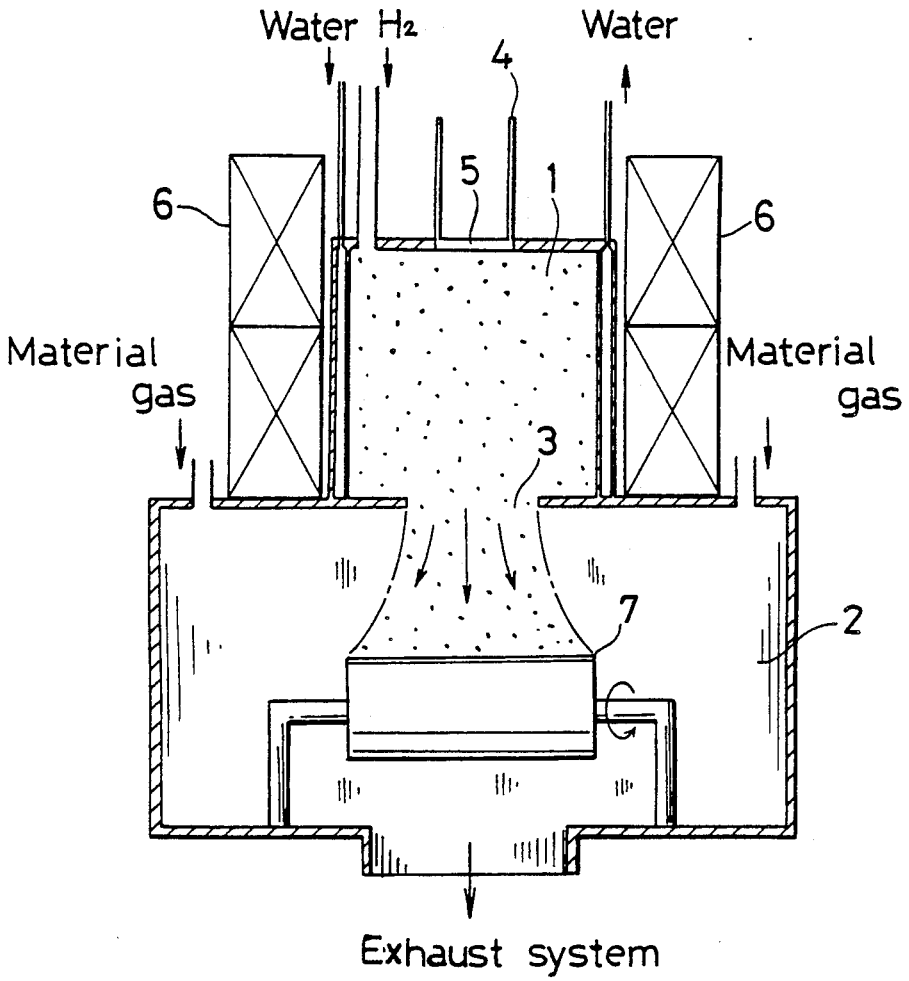
FIG. 5 is a schematic illustration of a deposition apparatus for a-SiGe film by ECR method.

FIG. 5 is a schematic view showing a deposition apparatus for a-SiGe layer by ECR method. It is to be noted that a deposition of a-Si layer is made by the same apparatus.

The apparatus comprises a plasma formation chamber 1 for generating plasma and a specimen chamber 2 for depositing a-SiGe layer. The plasma formation chamber 1 communicates with the specimen chamber 2 through a plasma extracting orifice and is evacuated to vacuum by an oil diffusion pump and oil rotation pump (each not shown).

The plasma formation chamber 1 comprises a cavity resonator construction wherein a microwave at 2.45 CHz is introduced through a wave guide 4. To be noted is that a microwave introduction window 5 is made from a quartz glass plate through which microwave can pass. $H_2$ (or Ar or He) gas, if required, is introduced into the plasma formation chamber 1. Magnetic coil 6 is disposed around the plasma formation chamber 1. Magnetic coil 6 generates a plasma generation magnetic field (875G) and forms a divergent magnetic field for drawing out plasma generated in the plasma formation chamber 1 into the specimen chamber 2.

In the specimen chamber 2 is mounted a drum-like conductive substrate 7 made for example of Al. The conductive substare 7 is rotatably supported by a support member, so that a-SiGe is deposited uniformly on the surface of the substrate. A material gas of a-SiGe is introduced into the specimen chamber 2. The material gas employs Si compound containing hydrogen or halogen, Ge compound containing hydrogen or halogen, and the like. Specifically, the Si compound is $SiH_4$, $Si_2H_6$, $SiF_4$, $SiCl_4$, $SiHCl_3$, $SiH_2Cl_2$ and the like, and the Ge compound is $GeH_4$, $GeF_4$, $GeCl_4$ and the like. Also, when forming a photoconductive layer for positive charge, B compound is introduced as a material gas, and P compound is introduced for negative charge photoconductive layer. Furthermore, for example, $CH_4$ or the like is introduced for deposition of a surface layer.

To deposit a-SiGe layer on the conductive substrate 7 by the above-mentioned construction, the plasma formation chamber 1 and the specimen chamber 2 are subjected to vacuum by an exhaust system, and when required, $H_2$ gas is introduced into the plasma formation chamber 1 and a material gas into the specimen chamber 2. Next, a microwave is introduced into the plasma formation chamber 1, while a magnetic field is caused by the magnetic coil 6 so as to excite plasma. Material gas subjected to plasma is directed to the conductive substrate 7 by divergent magnetic field, so that a-SiGe is deposited on the conductive substrate 7. Since the conductive substrate 7 is rotated by the support member, a-SiGe is deposited uniformly on the surface of the substrate 7. When the location, opening and the like of the plasma draw-out window is adjusted, uniformity of deposition for a-SiGe layer can be improved.

In formation of the a-SiGe layer in the above-mentioned apparatus, a setting of specific pressure of the material gas can adjust a content of hydrogen and/or halogen in the a-SiGe layer.

FIG. 1 is an explanatory view showing the relationship between hydrogen content in the a-SiGe layer and gas pressure. Employed gas material and testing conditions are as follows.

Figure 2:
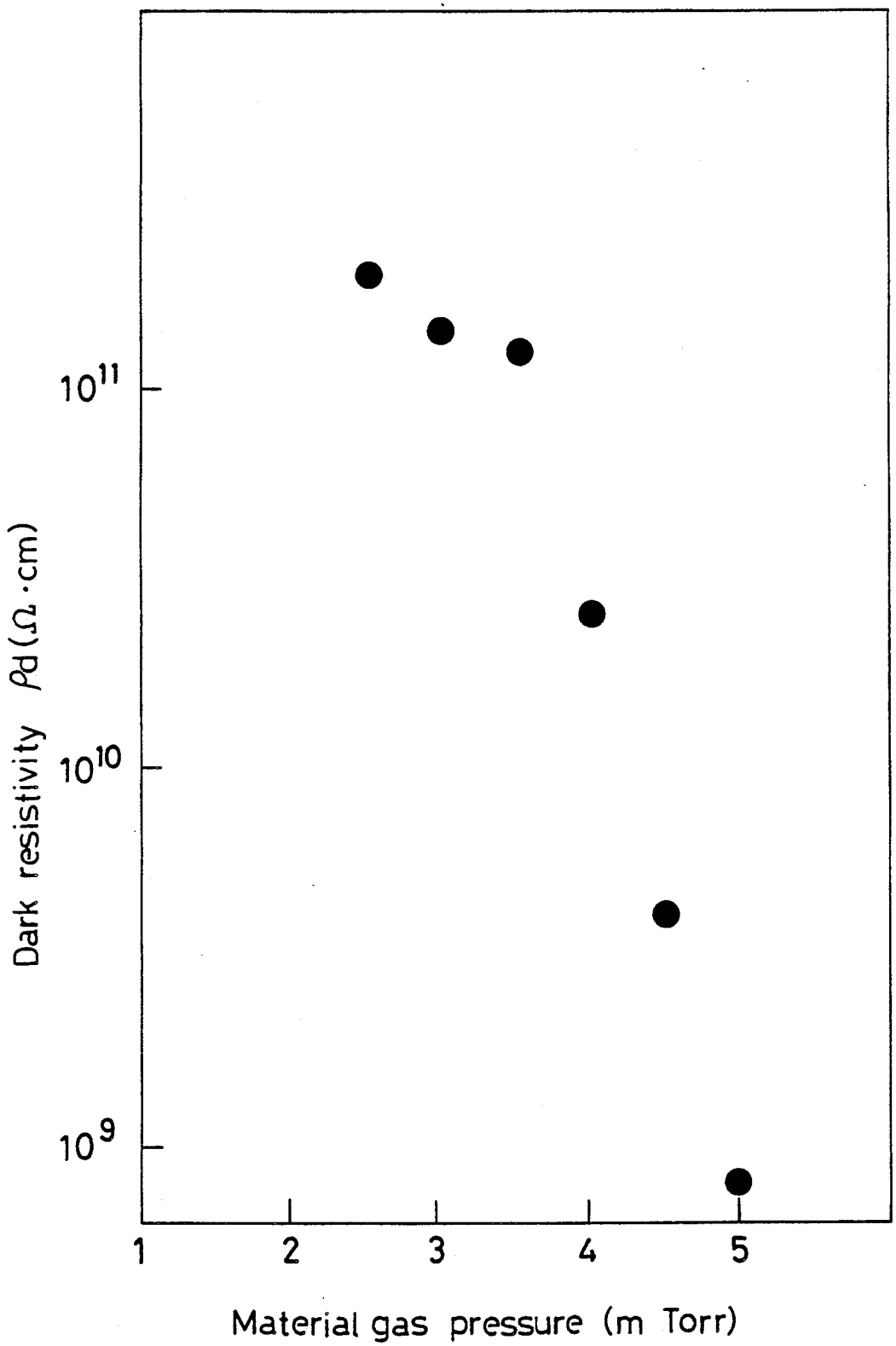
FIGS. 2 and 3 are explanatory views showing the relationship between material gas pressure upon the film deposition of a-SiGe photosensitive layer by ECR method and dark resistivity or photoconductivity ($n\mu\tau$) of the deposited photoconductive layer.
Figure 3:
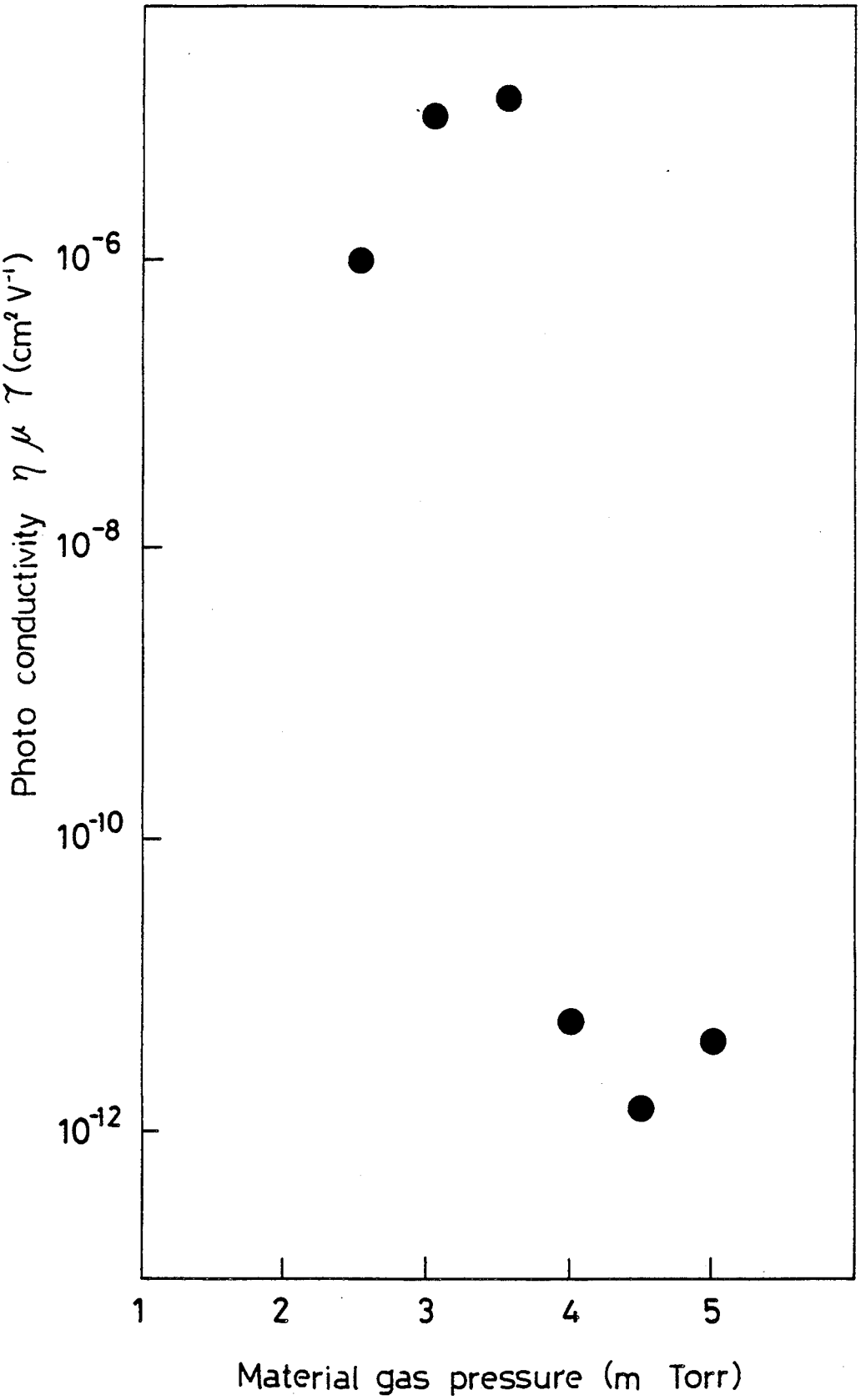

Microwave output : 2.5 kw
Material gas $SiH_4$, $GeH_4$
Gas flow rate $SiH_4+GeH_4=120$ (sccm)
$SiH_4/(SiH_4+GeH_4)=0.88$
Gas pressure 2.5–5.0 m Torr
Heating to the substrate none Hydrogen content in the a-SiGe photoconductive layer deposited by specific variables of the gas pressure in the above-mentioned range is shown in FIG. 1. As seen, when gas pressure is less than about 3.5 m Torr, hydrogen content is more than 40 atomic %, and when gas pressure exceeds that value, hydrogen content notably lowers to a value less than 25 atomic %. FIGS. 2 and 3 show dark resistivity of a-SiGe layer deposited accordingly and photoconductivity ($\kappa\mu\tau$) with a light source by semiconductor laser (830 nm) respectively. As seen, when gas pressure less than almost 3.5 m Torr is selected to provide hydrogen of more than 40 atomic % in the layer, it can at last provide such preferable property for photoconductive layer for an electrophotographic sensitizing element with a light source by semiconductor laser that dark resistivity is more than $10^{11}\Omega$cm and photoconductivity is more than $10^{-6}\Omega$cm.

When hydrogen content in the a-SiGe layer exceeds almost 65 atomic %, optical bandgap increases and leads to eliminate the longwave sensitivity property caused by adding Ge. Hence, it is preferable that hydrogen content is in an extent of 40–65 atomic % (more preferably in an extent of 43–55 atomic %).

Next, a ratio of Si and Ge in the a-SiGe layer will be detailed. The inventors have tested a relationship between a ratio of Si : Ge in the layer and a property of of a-SiGe deposited in such manner that gas pressure (almost 2.5–3.5 m Torr) is restrained for providing hydrogen content of 43–48 atomic % in a-SiGe layer and a ratio of Siliconic material gas and Germanous material gas is varied. From the tests, when Ge is almost less than 5.3 atomic % with respect to Si, there has hardly seen a reduction of optical bandgap by Ge addition and an improvement of sensitivity in the longer wave range, so that the feature is not enough for a photoconductive layer for photosensitive member of semiconductor laser. Also, when Ge amount is almost more than 150 atomic % with respect to Si amount, the optical bandgap is reduced but dark resistivity becomes much smaller to thereby cause charge acceptance and dark decay characteristic to be lower, which feature is not suitable for photoconductive layer for electrophotographic photosensitive member. In detail, it is relevant that Ge amount in a-SiGe layer is 5.3–150 atomic % with respect to Si amount (preferably 18–82 atomic %, more preferably 43–67 atomic %).

As seen from the above, the deposition apparatus by ECR method is used where microwave output is 2.5 kw, the substrate is not heated, gas pressure of material gas and the material gas ratio are adjusted, so that it can provide a favorable photoconductive layer. Upon the deposition of a-SiGe layer, a rate of film-deposition at gas pressure (2.5–3.5 m Torr) where a-SiGe layer having a favorable property can be deposited is 0.5 μm/min which is higher than other cases wherein film-deposition was made at different gas pressure, resulting in that the film-deposition could be performed more quickly at 5–6 times in higher rate in comparison with the conventional method. This shows that the present invention can provide such advantage that it can deposit a high quality photoconductive layer with a higher film-deposition rate. Also, there is no u generation of polymeric power mainly from $(SiH_2)n$ to thereby have no deficiency in the resulting film (which leads deficiency for image-formation), to that yield of the photosensitive member can be improved so as to enable production of photosensitive member with a lower cost.

In the above-mentioned explanation, the material gas for a-SiGe layer employs hydrogen compounds of Si, Ge, so that the a-SiGe layer naturally contains hydrogen. In case that halogen compound of Si, Ge is used, it is preferable that a total amount of hydrogen and/or halogen in a-SiGe layer is 40–65 atomic % (more preferably 43–55 atomic %).

The above-mentioned explanation relates to a-SiGe layer used as photoconductive layer. An electrophotographic photosensitive member, as an example, is so constructed as shown in FIG. 4 that an intermediate layer 11, photoconductive layer 12 and a surface layer 13 are deposited on a conductive substrate 7 made of Al or the like. The intermediate layer 11, photoconductive layer 12, surface layer 13 are all constituted by amorphous silicon or amorphous silicon alloy, so that conditions for film-deposition such as kinds, flow amount and the like of the material gas are changed so as to deposit the layers containing Ge, C and the like. A practical process of deposition of a-SiGe photosensitive member will be detailed as follows.

EXAMPLE: 1

Table 1 shows deposition conditions for positive charge photosensitive (p type), wherein the intermediate layer is a-Si layer to which B is much doped, the photoconductive layer is a-SiGe layer to which B at a smaller amount is doped, and the surface layer is a-SiC layer, which are all made by ECR method. Hydrogen content in the photoconductive layer deposited under the shown conditions is 46 atomic %. Property of the deposited photosensitive member was favorable in view of practical measuring of the property, particularly superior in charge acceptance and dark decay characteristic. Also, image-formation was made by use of a positive charge laser printer through this photosensitive member, and a high quality picture image can be obtained.

Also, there causes no polymeric powder comprising mainly of (SiH2)n upon film-deposition, so that there is no film-deposition deficiency, thereby enabling to obtain such a considerable favorable result in the film-deposition rate and usage efficiency of material gas as 6–10 times in comparison with the conventional methods.

TABLE 1

| | Output of μ-wave (kW) | Flow rate of material gas (sccn) | | | | Pressure of material gas (m Torr) | Thickness of layer (um) |
|---|---|---|---|---|---|---|---|
| | | $SiH_4$ | $B_2H_6$ | $GeH_4$ | $CH_4$ | | |
| Intermediate layer | 2.5 | 120 | 20* | 0 | 0 | 3.0 | 2.5 |
| Photoconductive layer | 2.5 | 105 | 12.5** | 0 | 0 | 3.2 | 28 |
| Surface layer | 2.5 | 30 | 0 | 0 | 1000 | 3.0 | 0.3 |

*3000 ppm in $H_2$ gas
**30 ppm in $H_2$ gas

EXAMPLE: 2

Under the same deposition conditions for a-SiGe photosensitive member as shown in Table 1 except that only gas pressure in case of deposition of photoconductive layer is changed, a-SiGe photosensitive member was made. Gas pressure employs such six kinds of values as 2.5, 3.0, 3.5, 4.0, 4.5, 5.0 (m Torr), those together with charge acceptance and dark decay characteristic of the deposited photoreceptor for electrophotography and a quality of image made by the same being shown in Table 2. Gas pressure where hydrogen content of the deposited a-SiGe photosensitive member 40–65 atomic % is 2.5, 3.0 and 3.5 (m Torr). As seen from the Table 2 (with being excellent; being good; Δ being poor; and X being no good), when hydrogen content is 40–65 atomic % (i.e, gas pressure at 2.5, 3.0 and 3.5 (m Torr)), charge acceptance and dark decay characteristic and quality of formed image are in favorable state.

In the tests 1 and 2, other hydrogen compounds and halogen compounds such as $Si_2H_6$, $SiF_4$, $SiCl_4$ and the like may be used as material gas which supplies Si and Ge atom and $BH_3$, $BCl_3$ and the like may be used as material gas for that supplies B atom. Also Al, Ga, In and the like other than B may be added for the deposition of a positive charged photosensitive member. Furthermore, a-SiN and a-SiO deposited by ECR method are available for the surface layer too.

TABLE 2

| Gas pressure (m Torr) | 2.5 | 3.0 | 3.5 | 4.0 | 4.5 | 5.0 |
|---|---|---|---|---|---|---|
| Charge acceptance and dark decay characteristic | | | | | Δ | X |
| Image property | | | | X | X | X |

EXAMPLE: 3

Table 3 shows conditions for the deposition of a negative charged photosensitive member (n type). Intermediate layer is a-Si layer to which P is much doped, photoconductive layer is a-SiGe layer to which P at a smaller amount is doped, and surface layer is a-SiC layer, which are all made by ECR method. Hydrogen content of the photoconductive layer deposited under the shown conditions is 46 atomic %, and the property of the photosensitive member is superior particularly in charge acceptance and dark decay characteristic. In image formation by negative charge laser printer using this photosensitive member, a high quality image could be obtained.

Upon film-deposition, there causes no polymeric powder comprising mainly of $(SiH_2)n$, so that no film deposition deficiency occurs and a favorable effect in film deposition rate and usage efficiency of material gas could be obtained.

TABLE 3

| | Output of μ-wave (kW) | Flow rate of material gas (sccn) $SiH_4$ | $PH_3$ | $GeH_4$ | $CH_4$ | Pressure of material gas (m Torr) | Thickness of layer (um) |
|---|---|---|---|---|---|---|---|
| Intermediate layer | 2.5 | 120 | 1.5* | 0 | 0 | 3.0 | 2.5 |
| Photoconductive layer | 2.5 | 105 | 1.2** | 15 | 0 | 3.0 | 28 |
| Surface layer | 2.5 | 30 | 0 | 0 | 1000 | 3.0 | 0.3 |

*3000 ppm in $H_2$ gas
**30 ppm in $H_2$ gas

EXAMPLE: 4

A-SiGe photosensitive member was provided under the same deposition conditions of the a-SiGe photosensitive member as shown in Table 3 except that only gas pressure condition for deposition of photoconductive layer was changed. Gas pressure uses such six kinds of values as 1.5, 2.8, 3.3, 3.8, 4.3, 4.8 (m Torr), those with charge acceptance and dark decay characteristic of the deposited photoreceptor for electrophotography and a quality of image formed by the same being shown in Table 4. Gas pressure where hydrogen content in the formed a-SiGe photosensitive is 40–65 atomic % is 2.5, 2.8, 3.3 (m Torr), and the formed a-SiGe photosensitive at the values of gas pressure has a favorable charge acceptance and dark decay characteristic and a favorable quality of formed image.

TABLE 4

| Gas pressure (m Torr) | 2.4 | 2.8 | 3.3 | 3.8 | 4.3 | 4.8 |
|---|---|---|---|---|---|---|
| Charge acceptance and dark decay characteristic | | | | | Δ | X |
| Image property | | | | X | X | X |

In the Examples 3 and 4, other hydrogen compounds and halogen compounds such as $Si_2H_6$, $SiF_4$, $SiCl_4$ and the like may be used as material gas which supplies Si and Ge atom, $PCl_3$ and the like may be used as material gas which supplies P atom. Also, a-SiN and a-SiC deposited by ECR method are available for the surface layer.

The a-SiGe layer of the present invention may be applicable to any photosensitive portion other than the photosensitive member for electrophotography, the photosensitive portion being provided in such a device, wherein optical information obtained from the outside is converted to electrical signals, as an image sensor, an image memory element which consist of a-Si layer and liquid crystal. Also, the a-SiGe layer may be applicable such a device as solar battery.

The photosensitive member for electrophotography of the present invention concerns an increased dark resistivity by limiting a total content of hydrogen and/or halogen in the photoconductive layer to 40–65 atomic %, so that charge acceptance and dark decay characteristic of the photosensitive can be improved, and an improved photosensitivity can be obtained by an increased photoconductivity.

Furthermore, by limiting Ge content with respect to Si content to 5.3–150 atomic % an optical bandgap is reduced, so that photosensitivity in long wave range can be improved correspondingly to a semiconductor laser.

As seen from the above, the present invention can improve property of a photosensitive member and a quality of image formed by the same.

What we claimed is:

1. A photosensitive member for electrophotography comprising a conductive substrate and a photoconductive layer, said photoconductive layer being an amorphous silicon germanium containing a member selected from the group consisting of hydrogen, halogen and mixtures thereof a greater than 40 atomoic %.

2. The photosensitive member according to claim 1, wherein said photoconductive layer is deposited utilizing an electron cyclotron resonance method.

3. The photosensitive member according to claim 1, wherein said amorphous silicon germanium contains said member selected from the group consisting of hydrogen, halogen and mixtures thereof at an amount up to 65 atomic %.

4. The photosensitive member according to claim 1 wherein said amorphous silicon germainium contains hydrogen at 43–55 atomic %.

5. The photosensitive member according to claim 1, wherein said amorphous silicon germainum contains Ge at 5.3–150 atomic %, based on Si.

6. The photosensitive member according to claim 5, wherein said amorphous silicon germanium contains Ge at 18–82 atomic %, based on Si.

7. The photosensitive member according to claim 6, wherein said amorphous silicon germanium contains Ge at 43–67 atomoic %, based on Si.

8. The photosensitive member according to claim 1, further comprising an intermediate layer between said conductive substrate and said photoconductive layer.

9. The photosensitive member according to claim 8, wherein said photoconductive layer has a free surface, and further comprising a surface layer over said free surface of the photoconductive layer.

10. The photosensitive member according to claim 1, wherein said conductive substrate comprises an aluminum plate.

11. A process for manufacturing a photosensitive member for electrophotography comprising depositing by electron cyclotron resonance a photoconductive layer of amorphous silicon germainium on a conductive substrate under conditions to obtain a member selected from the group consisting of hydrogen, halogen and mixtures thereof in said photoconductive layer at greater than 40 atomic %.

12. The process for manufacturing a photosensitive member according to claim 11, wherein said amorphous silicon germanium is deposited under conditions to obtain said member selected from the group consisting of hydrogen, halogen and mixtures thereof in said photoconductive layer at an amount up to 65 atomic %.

13. The process for manufacturing a photosensitive member according to claim 11, wherein said amorphous silicon germanium is deposited under conditions to obtain hydrogen in said photoconductive layer at 43–55 atomic %.

14. The process for manufacturing a photosensitive member according to claim 11, wherein said amorphous silicon germanium contains Ge at 5.3–150 atomic %, based on Si.

15. The process for manufacturing a photosensitive member according to claim 14, wherein said amorphous silicon germanium contains Ge at 18–82 atomic %, based on Si.

16. The process for manufacturing a photosensitive member according to claim 15, wherein said amorphous silicon germanium contains Ge at 43–67 l atomic %, based on Si.

17. The process for manufacturing a photosensitive member according to claim 11, further comprising depositing an intermediate layer between said conductible substrate and said photoconductive layer.

18. The process for manufacturing a photosensitive member according to claim 17, wherein said photoconductive layer has a free surface, and further comprising depositing a surface layer over said free surface of the photoconductive layer.

19. The process for manufacturing a photosensitive member according to claim 11, wherein said conductive substrate comprises an aluminum plate.

20. A product produced by the process of claim 11.

21. A product produced by the process of claim 12.

22. A product produced by the process of claim 14.

* * * * *